US009966042B2

(12) United States Patent
Deng

(10) Patent No.: US 9,966,042 B2
(45) Date of Patent: May 8, 2018

(54) METHOD FOR CALIBRATING BRIGHTNESS UNEVENNESS OF OLED DISPLAY PANEL

(71) Applicant: Shenzhen China Star Optoelectronics Technology Co., Ltd., Shenzhen, Guangdong (CN)

(72) Inventor: Yufan Deng, Guangdong (CN)

(73) Assignee: Shenzhen China Star Optoelectronics Technology Co., Ltd, Shenzhen, Guangdong (CN)

( * ) Notice: Subject to any disclaimer, the term of this patent is extended or adjusted under 35 U.S.C. 154(b) by 258 days.

(21) Appl. No.: 15/025,272

(22) PCT Filed: Mar. 2, 2016

(86) PCT No.: PCT/CN2016/075310

§ 371 (c)(1),
(2) Date: Mar. 26, 2016

(87) PCT Pub. No.: WO2017/140003

PCT Pub. Date: Aug. 24, 2017

(65) Prior Publication Data

US 2018/0040295 A1 Feb. 8, 2018

(30) Foreign Application Priority Data

Feb. 16, 2016 (CN) ..... 2016 1 0088157

(51) Int. Cl.

| | |
|---|---|
| ***G09G 3/3208*** | (2016.01) |
| ***G09G 5/10*** | (2006.01) |
| ***G09G 3/20*** | (2006.01) |

(52) U.S. Cl.

CPC ..... *G09G 5/10* (2013.01); *G09G 3/2007* (2013.01); *G09G 3/3208* (2013.01);
(Continued)

(58) Field of Classification Search

CPC ..... G09G 5/10; G09G 3/2007; G09G 3/3208; G09G 2320/0233; G09G 2320/0673;
(Continued)

(56) References Cited

U.S. PATENT DOCUMENTS

2008/0136768 A1* 6/2008 Chuang ..... G09G 3/3406 345/102
2008/0284794 A1* 11/2008 Wang ..... G09G 3/3648 345/618

(Continued)

FOREIGN PATENT DOCUMENTS

CN 101315745 A 12/2008
CN 103680449 A 3/2014

(Continued)

*Primary Examiner* — Premal Patel
(74) *Attorney, Agent, or Firm* — Andrew C. Cheng

(57) ABSTRACT

The present disclosure provides a method for calibrating brightness unevenness of an OLED display panel, the method includes: getting a brightness matrix of an OLED display panel in at least three gray scales, and determining a uniform brightness area and an uneven brightness area, and calculating a fitting Gamma value of each pixel corresponding to the at least three gray scales in the uneven brightness area, and fitting the fitting Gamma curve of the each pixel in the uneven brightness area, and calibrating the brightness of the uneven brightness area based on the fitting Gamma curve of the each pixel. The present disclosure can improve the accurate of the calibrating brightness and the efficiency of the calibration.

18 Claims, 2 Drawing Sheets

(52) U.S. Cl.
CPC ..... *G09G 2320/0233* (2013.01); *G09G 2320/0285* (2013.01); *G09G 2320/0673* (2013.01); *G09G 2320/0693* (2013.01)

(58) Field of Classification Search
CPC ... G09G 2320/0285; G09G 2320/0693; G09G 2320/0271; G09G 2320/0276; G09G 2320/029; G09G 2320/0295; G09G 2320/0686
See application file for complete search history.

(56) References Cited

U.S. PATENT DOCUMENTS

2008/0309766 A1* 12/2008 Lin ..... H04N 9/69 348/179
2012/0300094 A1* 11/2012 Kaida ..... H04N 5/2351 348/222.1
2014/0022287 A1* 1/2014 Ahn ..... G09G 3/3607 345/690
2014/0253602 A1* 9/2014 Wu ..... G09G 3/20 345/690
2015/0187328 A1* 7/2015 Kim ..... G09G 5/02 345/690
2015/0206485 A1* 7/2015 Kim ..... G09G 3/3607 345/690
2016/0148582 A1* 5/2016 Chung ..... G09G 3/3611 345/89
2016/0260368 A1 9/2016 Zheng
2016/0267838 A1 9/2016 Zhang et al.
2017/0046995 A1 2/2017 Chen et al.
2017/0193928 A1 7/2017 Deng

FOREIGN PATENT DOCUMENTS

CN 104008736 A 8/2014
CN 104269157 A 1/2015

* cited by examiner

METHOD FOR CALIBRATING BRIGHTNESS UNEVENNESS OF OLED DISPLAY PANEL

FIELD OF THE DISCLOSURE

The present disclosure relates to an OLED display technology field, and more particularly to a method for calibrating brightness unevenness of an OLED display panel.

BACKGROUND OF THE DISCLOSURE

The prior art of removing Mura defect of the OLED (Organic Light-Emitting Diode) panel is similar to the LCD (Liquid Crystal Display), which getting the brightness of the each pixel on the panel first, then measuring the Mura (Japanese, the term of the display technology field means uneven brightness) and setting the ideal brightness of the Mura area, finally calculating the gray scale value or the voltage value of compensating the Mura area needed based on the Gamma curve or the gray—brightness table.

But the OLED is different from the LCD, the each pixel of the LCD Gamma curve is relatively consistent, the each pixel of the OLED Gamma curve is large-difference so that the OLED cannot in accordance with the unified compensation to the Mura.

In the prior art, estimated the corrected gray value based on the Gamma value and the ideal brightness, e.g. "Method and device for removing liquid crystal displayer Mura (CN201310695713.X)": the corrected gray scale value of the each pixel corresponding to the input image is calculated by the corrected brightness value of the each pixel corresponding to the input image and the gamma index. The disadvantage of this method is, the deviation of the Gamma curve of the each pixel of the OLED panel, especially the Mura area is larger. Cannot achieve the desired compensation effect based on estimating the gray scale value by the uniform Gamma value or the uniform Gamma curve.

Therefore, in practice, in order to obtain an ideal correction value of the gray scale, the steps of shooting→trimming the gray scale→shooting→trimming the gray scale is repeatedly needed. Because the time is limited, the above-described method only can obtain a plurality of the correction values of the gray scale, and then obtain the remaining correction value of the gray scale by interpolating.

Assuming in 48 gray scale, the brightness of the normal area (uniform brightness area) is 48 nit, and the brightness of the Mura area is 44 nit. According to the traditional scheme, first, shooting a few specific gray scales, such as 32 gray scale, 64 gray scale, 224 gray scale, etc., and getting the correction value of the Mura area corresponding to these gray scale values. Because the Gamma characteristic of the Mura area is unknown, a single adjustment is often less than the desired effect, and is generally requires repeated shooting and trimming the gray scale to achieve the uniform brightness. Then, establishing the original gray—correction gray scale look-up table, and finally, interpolating the other correction value of the gray scale. Assuming the interpolated correction value corresponding to the gray scale 48 is gray scale 51, adjusting the gray scale in the Mura area to 51 to achieve a uniform effect of full-screen 48 nit. This method is extremely inefficient, the repeated testing is required to reach the uniform brightness.

Therefore, providing a method for calibrating brightness unevenness of the OLED display panel is needed to solve the above technical problems.

SUMMARY OF THE DISCLOSURE

The present disclosure to solve the technical problem is providing a method for calibrating brightness unevenness of the OLED display panel, can improve the accuracy and the efficiency of the calibration.

To solve the above technical problem, an used aspect of the present disclosure is: providing a method for calibrating brightness unevenness of an OLED display panel, the method includes: a brightness matrix of an OLED display panel in at least three gray scales is got, the at least three gray scales includes: a highest gray scale 255, a minimum reference gray scale and a maximum reference gray scale set up by a reference gray scale when adjusting a Gamma; a uniform brightness area and an uneven brightness area are determined based on the brightness matrix; a found Gamma curve of the uniform brightness area is measured, and a fitting Gamma value of each pixel corresponding to the at least three gray scales in the uneven brightness area is calculated by the brightness matrix; fitting the fitting Gamma value based on the found Gamma curve respectively to obtain a fitting Gamma curve of the each pixel in the uneven brightness area; the uneven brightness area is calibrated by the fitting Gamma curve of the each pixel; the uneven brightness area calibrated by the fitting Gamma curve of the each pixel includes: a gray scale—brightness correspondence table based on the fitting Gamma curve of the each pixel is used to calculate the each pixel; finding the gray scale—brightness correspondence table of the each pixel to obtain a value of a correction gray scale of the each pixel, and the uneven brightness area is calibrated by the correction gray scale value.

Further, calculating the fitting Gamma value of the each pixel corresponding to the at least three gray scales in the uneven brightness area based on the brightness matrix includes: a brightness value of the each pixel of the at least three gray scales in the uneven brightness area is found by the brightness matrix; a fitting Gamma value of the each pixel of the at least three gray scales is calculated by the brightness value of the each pixel of the at least three gray scales in the uneven brightness area.

Further, calculating the fitting Gamma value of the each pixel of the at least three gray scales based on the brightness value of the each pixel of the at least three gray scales in the uneven brightness area includes: according to $\gamma_{pixel}=\ln(L/L_{max})/\ln(x/255)$, the fitting Gamma value of the each pixel of the at least three gray scales is calculated, further the $\gamma_{pixel}$ is the fitting Gamma value, the x is a gray scale value, the L is the brightness value corresponding to the gray scale, the $L_{max}$ is the brightness value of the highest gray value 255.

Further, fitting the fitting Gamma value based on the found Gamma curve respectively to obtain a fitting Gamma curve of the each pixel in the uneven brightness area includes the steps of: finding the at least three found Gamma values corresponding to the at least three gray scales on the found Gamma curve; calculating a found Gamma value corresponding to the each gray scale in the at least three gray scales and a Gamma difference of the fitting Gamma value respectively; according to the at least three gray scales and the at least three Gamma difference corresponding to the at least three gray scales, fitting a vector of the Gamma difference; subtracting the vector of the Gamma difference by the found Gamma curve to obtain the fitting Gamma curve.

Further, fitting the vector of the Gamma difference based on the at least three gray scales and the at least three Gamma difference corresponding to the at least three gray scales includes: the vector of the Gamma difference is fitted by the linear interpolation or the curve fitting based on the at least three gray scales and the at least three Gamma difference corresponding to the at least three gray scales.

Further, when fitting the vector of the Gamma difference, a set up boundary condition is: the Gamma difference is zero when the gray scale is zero, and the gray scale is higher than the maximum reference gray scale of the set up reference gray scale when adjusting the Gamma, lower than the Gamma difference corresponding to the maximum gray scale 255 and equal to the Gamma difference corresponding to the maximum reference gray scale.

Further, the step of getting a brightness matrix of an OLED display panel in at least three gray scales includes: photos are photographed respectively in the at least three gray scales; and the photos is parsed to get the brightness matrix corresponding to the each gray scale.

Further, a vector length of the Gamma difference is 256, and a nth element in the vector of the Gamma difference is the found Gamma corresponding to the found Gamma curve when the gray scale is n−1 and is the Gamma difference of the fitted Gamma value of the each pixel in the uneven brightness area when the gray scale is n−1.

To solve the above technical problem, another used aspect of the present disclosure is: providing a method for calibrating brightness unevenness of the OLED display panel, the method includes: a brightness matrix of an OLED display panel in at least three gray scales is got; a uniform brightness area and an uneven brightness area are determined by the brightness matrix; a found Gamma curve of the uniform brightness area is measured, and a fitting Gamma value of each pixel corresponding to the at least three gray scales in the uneven brightness area is calculated by the brightness matrix; fitting the fitting Gamma value based on the found Gamma curve respectively to obtain a fitting Gamma curve of the each pixel in the uneven brightness area; the uneven brightness area is calibrated by the fitting Gamma curve of the each pixel.

Further, calculating the fitting Gamma value of the each pixel corresponding to the at least three gray scales in the uneven brightness area based on the brightness matrix includes: a brightness value of the each pixel of the at least three gray scales in the uneven brightness area is found by the brightness matrix; a fitting Gamma value of the each pixel of the at least three gray scales is calculated by the brightness value of the each pixel of the at least three gray scales in the uneven brightness area.

Further, calculating the fitting Gamma value of the each pixel of the at least three gray scales based on the brightness value of the each pixel of the at least three gray scales in the uneven brightness area includes: according to $\gamma_{pixel}=\ln(L/L_{max})/\ln(x/255)$, the fitting Gamma value of the each pixel of the at least three gray scales is calculated, further, the $\gamma_{pixel}$ is the fitting Gamma value, the x is a gray scale value, the L is the brightness value corresponding to the gray scale, the $L_{max}$ is the brightness value of the highest gray value 255.

Further, fitting the fitting Gamma value based on the found Gamma curve respectively to obtain a fitting Gamma curve of the each pixel in the uneven brightness area includes: the at least three found Gamma values corresponding to the at least three gray scales on the found Gamma curve is found; a found Gamma value corresponding to the each gray scale in the at least three gray scales and a Gamma difference of the fitting Gamma value are calculated respectively; according to the at least three gray scales and the at least three Gamma difference corresponding to the at least three gray scales, a vector of the Gamma difference is fitted; the vector of the Gamma difference is subtracted by the found Gamma curve to obtain the fitting Gamma curve.

Further, fitting the vector of the Gamma difference based on the at least three gray scales and the at least three Gamma difference corresponding to the at least three gray scales includes: the vector of the Gamma difference is fitted by the linear interpolation or the curve fitting based on the at least three gray scales and the at least three Gamma difference corresponding to the at least three gray scales.

Further, when fitting the vector of the Gamma difference, a set up boundary condition is: the Gamma difference is zero when the gray scale is zero, and the gray scale is higher than the maximum reference gray scale of the set up reference gray scale when adjusting the Gamma, lower than the Gamma difference corresponding to the maximum gray scale 255 and equal to the Gamma difference corresponding to the maximum reference gray scale.

Further, the at least three gray scales includes: a highest gray scale 255, a minimum reference gray scale and a maximum reference gray scale set up by a reference gray scale when adjusting a Gamma.

Further, the uneven brightness area calibrated by the fitting Gamma curve of the each pixel includes: a gray scale—brightness correspondence table based on the fitting Gamma curve of the each pixel is used to calculate the each pixel; finding the gray scale—brightness correspondence table of the each pixel to obtain a value of a correction gray scale of the each pixel, and calibrating the uneven brightness area by the correction gray scale value.

Further, the step of getting a brightness matrix of an OLED display panel in at least three gray scales includes: photos are photographed respectively in the at least three gray scales; the photos are parsed to get the brightness matrix corresponding to the each gray scale.

Further, a vector length of the Gamma difference is 256, and a nth element in the vector of the Gamma difference is the found Gamma corresponding to the found Gamma curve when the gray scale is n−1 and is the Gamma difference of the fitted Gamma value of the each pixel in the uneven brightness area when the gray scale is n−1.

The beneficial effects of the present disclosure is that: different from the prior art, the present disclosure is by getting the brightness matrix of the OLED panel at least three gray scales, and determining the uniform brightness area and the uneven brightness area based on the brightness matrix, and determining the found Gamma curve of the uniform brightness area, and calculating the fitting Gamma value corresponding to the each pixel at least three gray scales in the uniform brightness area and the uneven brightness area based on the brightness matrix, and fitting the fitting Gamma curve of the each pixel in the uneven brightness area respectively based on the found Gamma curve and the fitting Gamma value, and calibrating the brightness of the uneven brightness area based on the fitting Gamma curve of the each pixel, without repeated shooting and trimming to obtain a brightness matrix. Compared to the traditional way of interpolating corrected value the present disclosure using fitting the fitting Gamma curve of the each pixel in the whole uneven brightness area then calibrating, it is more accurate. Therefore it can improve the accurate of the calibrating brightness and the efficiency.

DETAILED DESCRIPTION OF PREFERRED EMBODIMENTS

With reference to the following detailed description of the present disclosure.

Figure 1:
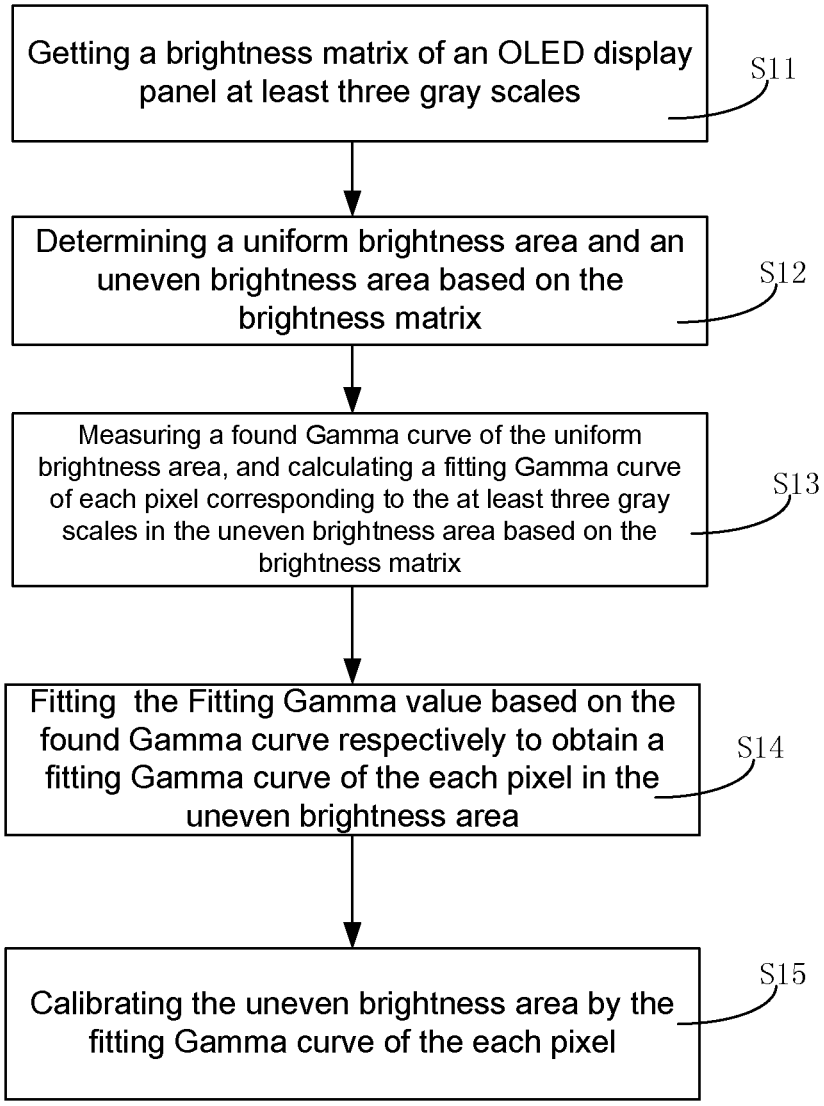
FIG. 1 is a flow chart of the method for calibrating brightness unevenness of OLED display panel of the preferred embodiment of the present disclosure.
Figure 2:
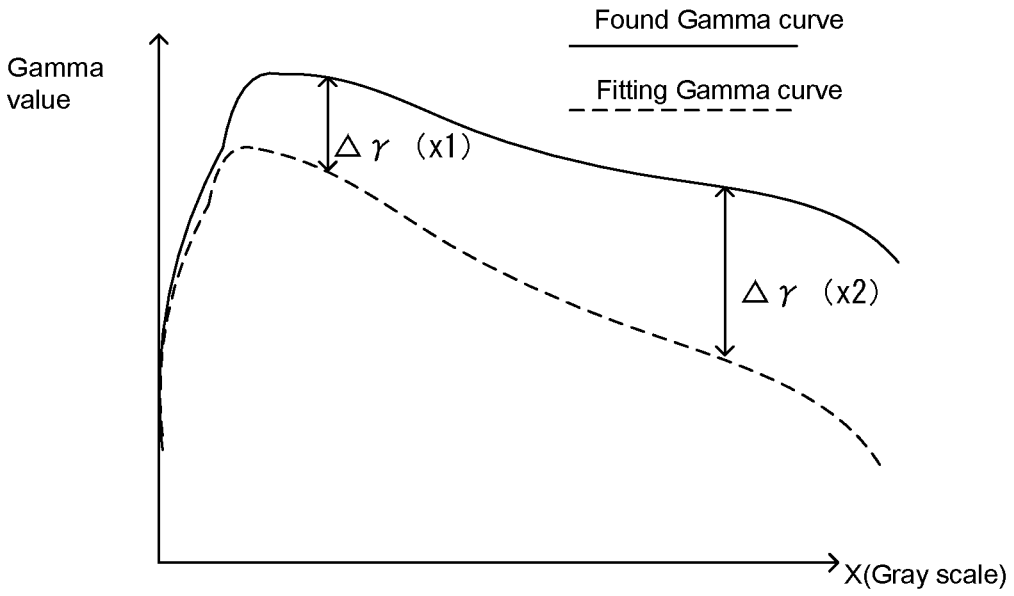
FIG. 2 is a schematic diagram of the fitting Gamma curve and the found Gamma curve.

Referring to FIG. 1 and FIG. 2, FIG. 1 is a flow chart of the method for calibrating brightness unevenness of OLED display panel of the preferred embodiment of the present disclosure. FIG. 2 is a schematic diagram of the fitting Gamma curve and the found Gamma curve. The fitting Gamma curve and the found Gamma curve in the FIG. 2 are only a schematic diagram, the actual fitting Gamma curve and the actual found Gamma curve can be other shapes. In the present embodiment, the method for calibrating the brightness unevenness of the OLED display panel includes:

Step S11: getting a brightness matrix of an OLED display panel in at least three gray scales.

In the step S11: preferably, getting a brightness matrix of an OLED display panel in at least three gray scales includes: shooting in at least three gray scales, and analyzing the photos to obtain the brightness matrix corresponding to the each gray scale.

The brightness matrix reflects the position of the pixel and the brightness corresponding to the position.

Preferably, the at least three gray scales includes: a highest gray scale 255 and a minimum reference gray scale and a maximum reference gray scale set up by a reference gray scale when adjusting a Gamma.

Step S12: determining a uniform brightness area and an uneven brightness area based on the brightness matrix.

Step S13: measuring a found Gamma curve of the uniform brightness area, and calculating a fitting Gamma value of each pixel corresponding to the at least three gray scales in the uneven brightness area based on the brightness matrix.

In the step S13, calculating the fitting Gamma value of the each pixel corresponding to the at least three gray scales in the uneven brightness area based on the brightness matrix includes: a brightness value of the each pixel of the at least three gray scales in the uneven brightness area is found by the brightness matrix; a fitting Gamma value of the each pixel of the at least three gray scales is calculated by the brightness value of the each pixel of the at least three gray scales in the uneven brightness area.

The fitting Gamma value is used to fit the Gamma curve of the each pixel in the uneven brightness area, calculated by the above method was not fitting.

The Gamma curve of the each pixel in the uniform brightness area are all the same.

Calculating the fitting Gamma value of the each pixel of the at least three gray scales based on the brightness value of the each pixel of the at least three gray scales in the uneven brightness area includes: according to (1) $\gamma_{pixel}=\ln(L/L_{max})/\ln(x/255)$, the fitting Gamma value of the each pixel of the at least three gray scales is calculated, further, the $\gamma_{pixel}$ is the fitting Gamma value, x is a gray scale value, the L is the brightness value corresponding to the gray scale, the $L_{max}$ is the brightness value of the highest gray value 255.

Step S14: fitting the fitting Gamma curve of the each pixel in the uneven brightness area respectively based on the found Gamma curve and the fitting Gamma value.

In the step S14, fitting the fitting Gamma curve of the each pixel in the uneven brightness area respectively based on the found Gamma curve and the fitting Gamma value includes: the at least three found Gamma values corresponding to the at least three gray scales on the found Gamma curve is found; a found Gamma value corresponding to the each gray scale in the at least three gray scales and a Gamma difference of the fitting Gamma value are calculated respectively; according to the at least three gray scales and the at least three Gamma difference corresponding to the at least three gray scales, a vector of the Gamma difference is fitted; subtracting the vector of the Gamma difference by the found Gamma curve to obtain the fitting Gamma curve.

Preferably, calculating the Gamma difference by (2)$\Delta\gamma(x)=\gamma_{meas}-\gamma_{pixel}$, the $\Delta\gamma$ is the Gamma difference, the x is the gray scale, the $\gamma_{meas}$ is the gray scale value corresponding to the found Gamma curve, the $\gamma_{pixel}$ is fitting value corresponding to the pixel (calculated by step S13).

Fitting the vector of the Gamma difference based on the at least three gray scales and the at least three Gamma difference corresponding to the at least three gray scales includes: the vector of the Gamma difference by the linear interpolation or the curve fitting is fitted by the at least three gray scales and the at least three Gamma difference corresponding to the at least three gray scales. Preferably, the relationship between the gray scale and the Gamma difference corresponding to the gray scale is a linear relationship.

When fitting the vector of the Gamma difference, a set up boundary condition is: the Gamma difference is zero when the gray scale is zero, and the gray scale is higher than the maximum reference gray scale of the set up reference gray scale when adjusting the Gamma, lower than the Gamma difference corresponding to the maximum gray scale 255 and equal to the Gamma difference corresponding to the maximum reference gray scale, i.e. the boundary condition is: (3) $\Delta\gamma(0)=0$; (4)$\Delta\gamma(x)=\Delta\gamma(x_{ref})$, $x_{ref}<x<255$.

Further, the $\Delta\gamma(0)$ is the Gamma difference in the zero gray scale, i.e. is the difference between the Gamma value and the Gamma value of the pixel in the Mura area corresponding to the found curve when the gray scale is zero, the x is the gray scale, and the $x_{ref}$ is the maximum reference gray scale when adjusting the Gamma.

Step S15: calibrating the brightness of the uneven brightness area based on the fitting Gamma curve of the each pixel.

In the step S15, the uneven brightness area calibrated by the fitting Gamma curve of the each pixel includes: a gray scale—brightness correspondence table based on the fitting Gamma curve of the each pixel is used to calculate the each pixel; finding the gray scale—brightness correspondence table of the each pixel to obtain a value of a correction gray scale of the each pixel, and the uneven brightness area is calibrated by the correction gray scale value.

For example, assuming in 48 gray scale, the brightness of the uniform brightness area is 48 nit, and the brightness of the uneven brightness area is 44 nit. According to the present embodiment, first, shooting at least three gray scales, then combining with the found Gamma curve in the uniform brightness area to fitting the fitting Gamma curve of the each pixel in the uneven brightness area. According to the fitting Gamma curve can obtain the gray scale—brightness correspondence table in the uneven brightness area, in order to find the gray scale corresponding to the 48 nit and restore the gray scale of the pixel.

The present disclosure is by getting the brightness matrix of the OLED panel at least three gray scales, and determining the uniform brightness area and the uneven brightness area based on the brightness matrix, and determining the found Gamma curve of the uniform brightness area, and calculating the fitting Gamma value corresponding to the each pixel at least three gray scales in the uniform brightness area and the uneven brightness area based on the brightness matrix, and fitting the fitting Gamma curve of the each pixel in the uneven brightness area respectively based on the found Gamma curve and the fitting Gamma value, and calibrating the brightness of the uneven brightness area based on the fitting Gamma curve of the each pixel, without repeated shooting and trimming to obtain a brightness matrix. And compared to the traditional way of interpolating corrected value, the present disclosure fits the fitting Gamma curve of the each pixel in the whole uneven brightness area then calibrates, it is more accurate. Therefore it can improve the accurate of the calibrating brightness and the efficiency.

The above are only embodiments of the present disclosure is not patented and therefore limit the scope of the present disclosure, any use of the contents of the present specification and drawings made equivalent or equivalent structural transformation process, either directly or indirectly, use the other relevant technical fields are included in the patent empathy scope of the disclosure.

What is claimed is:

1. A method for calibrating brightness unevenness of an OLED display panel, wherein the method comprises the steps of:

getting a brightness matrix of an OLED display panel in at least three gray scales, wherein the at least three gray scales comprises: a highest gray scale 255 and a minimum reference gray scale and a maximum reference gray scale set up by a reference gray scale when adjusting a Gamma;

determining a uniform brightness area and an uneven brightness area based on the brightness matrix;

measuring a found Gamma curve of the uniform brightness area, and calculating a fitting Gamma value of each pixel corresponding to the at least three gray scales in the uneven brightness area based on the brightness matrix;

fitting the fitting Gamma value based on the found Gamma curve respectively to obtain a fitting Gamma curve of the each pixel in the uneven brightness area;

calibrating the uneven brightness area by the fitting Gamma curve of the each pixel;

the uneven brightness area calibrated by the fitting Gamma curve of the each pixel comprises: a gray scale—brightness correspondence table for calculating the each pixel by the fitting Gamma curve of the each pixel; finding the gray scale—brightness correspondence table of the each pixel to obtain a correction gray scale value of the each pixel, and calibrating the uneven brightness area by the correction gray scale value.

2. The method for calibrating brightness unevenness of the OLED display panel according to claim 1, wherein, based on the brightness matrix, calculating the fitting Gamma value corresponding to the each pixel of the at least three gray scales in the uneven brightness area comprises the steps of:

finding a brightness value of the each pixel of the at least three gray scales in the uneven brightness area based on the brightness matrix;

calculating a fitting Gamma value of the each pixel of the at least three gray scales based on the brightness value of the each pixel of the at least three gray scales in the uneven brightness area.

3. The method for calibrating brightness unevenness of the OLED display panel according to claim 2, wherein calculating the fitting Gamma value of the each pixel of the at least three gray scales based on the brightness value of the each pixel of the at least three gray scales in the uneven brightness area comprises:

according to $\gamma_{pixel}=\ln(L/L_{max})/\ln(x/255)$, calculating the fitting Gamma value of the each pixel of the at least three gray scales, wherein the $\gamma_{pixel}$ is the fitting Gamma value, the x is a gray scale value, the L is the brightness value corresponding to the gray scale and the $L_{max}$ is the brightness value of the highest gray value 255.

4. The method for calibrating brightness unevenness of the OLED display panel according to claim 1, wherein fitting the fitting Gamma value based on the found Gamma curve respectively to obtain a fitting Gamma curve of the each pixel in the uneven brightness area comprises the steps of:

finding the at least three found Gamma values corresponding to the at least three gray scales on the found Gamma curve;

calculating a found Gamma value corresponding to the each gray scale in the at least three gray scales and a Gamma difference of the fitting Gamma value respectively;

according to the at least three gray scales and the at least three Gamma difference corresponding to the at least three gray scales, fitting a vector of the Gamma difference;

subtracting the vector of the Gamma difference by the found Gamma curve to obtain the fitting Gamma curve.

5. The method for calibrating brightness unevenness of the OLED display panel according to claim 4, wherein fitting the vector of the Gamma difference based on the at least three gray scales and the at least three Gamma difference corresponding to the at least three gray scales comprises:

linear interpolation or curve fitting is used to fit the vector of the Gamma difference based on the at least three gray scales and the at least three Gamma difference corresponding to the at least three gray scales.

6. The method for calibrating brightness unevenness of the OLED display panel according to claim 4, wherein when fitting the vector of the Gamma difference, a set up boundary condition is: the Gamma difference is zero when the gray scale is zero, and the gray scale is higher than the maximum reference gray scale of the set up reference gray scale when adjusting the Gamma, lower than the Gamma difference corresponding to the maximum gray scale 255 and equal to the Gamma difference corresponding to the maximum reference gray scale.

7. The method for calibrating brightness unevenness of the OLED display panel according to claim 4, wherein a vector length of the Gamma difference is 256, and a nth element in the vector of the Gamma difference is the found Gamma corresponding to the found Gamma curve when the gray scale is n−1 and is the Gamma difference of the fitted Gamma value of the each pixel in the uneven brightness area when the gray scale is n−1.

8. The method for calibrating brightness unevenness of the OLED display panel according to claim 1, wherein the step of getting a brightness matrix of an OLED display panel in at least three gray scales comprises:

photographing photos respectively in the at least three gray scales;

parsing the photos to get the brightness matrix corresponding to the each gray scale.

9. A method for calibrating brightness unevenness of the OLED display panel, wherein the method comprises the steps of:

getting a brightness matrix of an OLED display panel in at least three gray scales;

determining a uniform brightness area and an uneven brightness area based on the brightness matrix;

measuring a found Gamma curve of the uniform brightness area, and calculating a fitting Gamma value of each pixel corresponding to the at least three gray scales in the uneven brightness area based on the brightness matrix;

fitting the fitting Gamma value based on the found Gamma curve respectively to obtain a fitting Gamma curve of the each pixel in the uneven brightness area;

calibrating the uneven brightness area by the fitting Gamma curve of the each pixel.

10. The method for calibrating brightness unevenness of the OLED display panel according to claim 9, wherein calculating the fitting Gamma value of the each pixel corresponding to the at least three gray scales in the uneven brightness area based on the brightness matrix comprises the steps of:

finding a brightness value of the each pixel of the at least three gray scales in the uneven brightness area based on the brightness matrix;

calculating a fitting Gamma value of the each pixel of the at least three gray scales based on the brightness value of the each pixel of the at least three gray scales in the uneven brightness area.

11. The method for calibrating brightness unevenness of the OLED display panel according to claim 10, wherein calculating the fitting Gamma value of the each pixel of the at least three gray scales based on the brightness value of the each pixel of the at least three gray scales in the uneven brightness area comprises:

according to $\gamma_{pixel}=\ln(L/L_{max})/\ln(x/255)$, calculating the fitting Gamma value of the each pixel of the at least three gray scales, wherein the $\gamma_{pixel}$ is the fitting Gamma value, the x is a gray scale value, the L is the brightness value corresponding to the gray scale, the $L_{max}$ is the brightness value of the highest gray value 255.

12. The method for calibrating brightness unevenness of the OLED display panel according to claim 9, wherein fitting the fitting Gamma value based on the found Gamma curve respectively to obtain a fitting Gamma curve of the each pixel in the uneven brightness area comprises the steps of:

finding the at least three found Gamma values corresponding to the at least three gray scales on the found Gamma curve;

calculating a found Gamma value corresponding to the each gray scale in the at least three gray scales and a Gamma difference of the fitting Gamma value respectively;

according to the at least three gray scales and the at least three Gamma difference corresponding to the at least three gray scales, fitting a vector of the Gamma difference;

subtracting the vector of the Gamma difference by the found Gamma curve to obtain the fitting Gamma curve.

13. The method for calibrating brightness unevenness of the OLED display panel according to claim 12, wherein fitting the vector of the Gamma difference based on the at least three gray scales and the at least three Gamma difference corresponding to the at least three gray scales comprises:

linear interpolation or curve fitting is used to fit the vector of the Gamma difference based on the at least three gray scales and the at least three Gamma difference corresponding to the at least three gray scales.

14. The method for calibrating brightness unevenness of the OLED display panel according to claim 12, wherein when fitting the vector of the Gamma difference, a set up boundary condition is: the Gamma difference is zero when the gray scale is zero, and the gray scale is higher than the maximum reference gray scale of the set up reference gray scale when adjusting the Gamma, lower than the Gamma difference corresponding to the maximum gray scale 255 and equal to the Gamma difference corresponding to the maximum reference gray scale.

15. The method for calibrating brightness unevenness of the OLED display panel according to claim 12, wherein a vector length of the Gamma difference is 256, and a nth element in the vector of the Gamma difference is the found Gamma corresponding to the found Gamma curve when the gray scale is n−1 and is the Gamma difference of the fitted Gamma value of the each pixel in the uneven brightness area when the gray scale is n−1.

16. The method for calibrating brightness unevenness of the OLED display panel according to claim 9, wherein the at least three gray scales comprises: a highest gray scale 255, a minimum reference gray scale and a maximum reference gray scale set up by a reference gray scale when adjusting a Gamma.

17. The method for calibrating brightness unevenness of the OLED display panel according to claim 9, wherein the uneven brightness area calibrated by the fitting Gamma curve of the each pixel comprises:

a gray scale—brightness correspondence table based on the fitting Gamma curve of the each pixel is used to calculate the each pixel;

finding the gray scale—brightness correspondence table of the each pixel to obtain a value of a correction gray scale of the each pixel, and calibrating the uneven brightness area by the correction gray scale value.

18. The method for calibrating brightness unevenness of the OLED display panel according to claim 9, wherein the step of getting a brightness matrix of an OLED display panel in at least three gray scales comprises:

photographing photos respectively in the at least three gray scales;

parsing the photos to get the brightness matrix corresponding to the each gray scale.

* * * * *